US011607102B2

(12) United States Patent
Zhang et al.

(10) Patent No.: US 11,607,102 B2
(45) Date of Patent: Mar. 21, 2023

(54) CLEANING ASSEMBLY AND CLEANING ROBOT

(71) Applicants: Yunjing Intelligence Technology (Dongguan) Co., Ltd., Dongguan (CN); Yunjing Intelligence (Shenzhen) Co., Ltd., Shenzhen (CN)

(72) Inventors: Junbin Zhang, Shenzhen (CN); Weijing Lin, Shenzhen (CN); Xingyan Li, Shenzhen (CN)

(73) Assignees: Yunjing Intelligence Technology (Dongguan) Co., Ltd., Dongguan (CN); Yunjing Intelligence (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/588,584

(22) Filed: Jan. 31, 2022

(65) Prior Publication Data

US 2022/0248929 A1 Aug. 11, 2022

(30) Foreign Application Priority Data

Feb. 10, 2021 (CN) ..... 202110187167.3

(51) Int. Cl.
*A47L 11/40* (2006.01)
*A47L 11/282* (2006.01)

(52) U.S. Cl.
CPC ..... *A47L 11/4055* (2013.01); *A47L 11/282* (2013.01); *A47L 11/4058* (2013.01); *A47L 11/4069* (2013.01); *A47L 2201/00* (2013.01)

(58) Field of Classification Search
CPC ..... A47L 11/4055; A47L 11/4052; A47L 11/4058; A47L 2201/00; A47L 11/282
USPC ..... 15/98
See application file for complete search history.

(56) References Cited

U.S. PATENT DOCUMENTS 3,460,184 A 8/1969 Dyer
5,243,727 A 9/1993 Tanaka et al.
5,483,718 A * 1/1996 Blehert ..... A47L 11/4061 15/325
5,867,864 A 2/1999 Miller et al.
6,530,102 B1 3/2003 Pierce et al.
(Continued)

FOREIGN PATENT DOCUMENTS

CN 103006153 A 4/2013
CN 206714711 U 12/2017
(Continued)

OTHER PUBLICATIONS

European Patent Office, European Search Report in European Application No. 22154101.4 (dated Jul. 13, 2022).
(Continued)

*Primary Examiner* — Laura C Guidotti
(74) *Attorney, Agent, or Firm* — Leydig, Voit & Mayer, Ltd.

(57) ABSTRACT

A cleaning assembly includes a cleaning device, a mounting base, and a swing arm. The cleaning device is movable in a vertical direction, and a positioning part is provided on the cleaning device. The mounting base is located at one side of the cleaning device. The swing arm has one end pivotally connected to the mounting base and another end connected to the positioning part. The swing arm is configured to swing with a vertical movement of the positioning part.

17 Claims, 9 Drawing Sheets

(56) References Cited

U.S. PATENT DOCUMENTS

| | | | | |
|---|---|---|---|---|
| 2003/0000549 | A1 | 1/2003 | Joynt et al. | |
| 2019/0261826 | A1 * | 8/2019 | Goff | A47L 11/24 |
| 2020/0139561 | A1 | 5/2020 | Kim et al. | |

FOREIGN PATENT DOCUMENTS

| | | | | | |
|---|---|---|---|---|---|
| CN | 208799170 | U | | 4/2019 | |
| CN | 209032139 | U | | 6/2019 | |
| CN | 209808233 | U | | 12/2019 | |
| CN | 110710932 | A | | 1/2020 | |
| DE | 4211789 | A1 | | 10/1993 | |
| EP | 0850010 | A1 | | 7/1998 | |
| EP | 1674013 | A1 | | 6/2006 | |
| EP | 3711649 | A1 | | 9/2020 | |
| JP | H0493054 | U | * | 4/1992 | A47L 11/283 |
| JP | H0652753 | U | * | 7/1994 | A47L 11/30 |
| JP | 2001112683 | A | * | 4/2001 | A47L 11/164 |
| JP | 201071327 | A | | 4/2010 | |
| JP | 2010194204 | A | * | 9/2010 | A47L 11/293 |
| JP | 2018132088 | A | | 8/2018 | |
| JP | 3224007 | U | | 11/2019 | |
| KR | 848568 | B1 | * | 7/2008 | A47L 11/28 |
| KR | 2019000892 | A | * | 1/2019 | A47L 11/14 |
| KR | 2019003776 | A | * | 1/2019 | A47L 11/14 |
| WO | 9708984 | A1 | | 3/1997 | |
| WO | 2019233493 | A1 | | 12/2019 | |

OTHER PUBLICATIONS

Japanese Patent Office, First Office Action in Japanese Patent Application No. 2022-012791 (dated Mar. 22, 2022).

European Patent Office, European Search Report in European Patent Application No. 22154103.0 (dated Jul. 13, 2022).

Japanese Patent Office, Notice of Rejection in Japanese Patent Application No. 2022-012791 (dated Jul. 12, 2022).

* cited by examiner

CLEANING ASSEMBLY AND CLEANING ROBOT

CROSS-REFERENCE TO RELATED APPLICATIONS

This application claims the benefit of priority to Chinese application No. 202110187167.3 filed on Feb. 10, 2021, which is hereby incorporated by reference in its entirety.

TECHNICAL FIELD

The present disclosures relates to the technical field of cleaning robots and, in particular, to a cleaning assembly and a cleaning robot with the same.

BACKGROUND

With the development of science and technology, cleaning robots are increasingly used in people's lives. An existing cleaning robot includes a mopping device for cleaning the ground and the like. However, the mopping device of such a cleaning robot cannot be lifted and kept in a lift position, which is not conducive to improving the adaptability of the cleaning robot. For example, the cleaning robot is difficult to make a rapid return to do self-cleaning when there is a need.

SUMMARY

One objective of the present disclosure is to provide a cleaning assembly for a cleaning robot. The cleaning device may be floatingly coupled to the cleaning robot and configured to move vertically in accordance with the surface being cleaned, thereby improving the adaptability of the cleaning robot.

Another objective of the present disclosure is to provide a cleaning robot, which is conducive to self-adaptive floating of the cleaning device, thereby improving the adaptability of a cleaning robot having the cleaning assembly.

To achieve the above objectives, the present disclosure provides a cleaning assembly including a cleaning device, a mounting base and a swing arm. Specifically, the cleaning device is movable in a vertical direction, and a positioning part is provided on the cleaning device; the mounting base is located at one side of the cleaning device; and the swing arm has one end pivotally connected to the mounting base and another end connected to the positioning part, and the swing arm is configured to swing with a vertical movement of the positioning part.

In some embodiment, the positioning part is slidably connected to the swing arm, and the vertical movement of the positioning part and a swing movement of the swing arm are mutually converted under a relative sliding action between the positioning part and the swing arm.

In some embodiment, the swing arm is provided with a sliding groove in which the positioning part is slidably configured, and the vertical movement of the positioning part and a swing movement of the swing arm are mutually converted under a sliding action of the positioning part in the sliding groove.

In some embodiment, the swing arm includes two arms arranged opposite to each other, both arms are respectively provided with the sliding groove, and the cleaning device is provided with two said positioning parts symmetrically arranged, and the two positioning parts are correspondingly slidably arranged in the two sliding grooves.

In some embodiment, the cleaning device is configured to move upward when applied with an upward force, to drive the swing arm to swing through the positioning part, and automatically return downward once the upward force disappears.

In some embodiment, the cleaning assembly further includes an elastic force applying member which is configured to store elastic potential energy when the cleaning device is moved upward, and the cleaning device is returned downward under actions of a gravity of the cleaning device and a release of the elastic potential energy.

In some embodiment, the elastic force applying member acting on the swing arm is configured to store elastic potential energy when the cleaning device is moved upward and release the elastic potential energy to facilitate a backswing of the swing arm.

In some embodiment, the elastic force applying member includes a compression spring connected between the mounting base and the swing arm, and the compression spring is compressed to store elastic potential energy when the swing arm swings upward.

In some embodiment, the swing arm includes a connecting arm and a pivoting arm, a first end of the connecting arm is cooperated with the positioning part, an upper end of the pivoting arm is connected to a second end of the connecting arm, a lower end of the pivoting arm is pivoted to the mounting base; and the compression spring is connected between the second end of the connecting arm and the mounting base.

In some embodiment, the elastic force applying member includes a torsion spring having a torsion spring body, a first torsion arm and a second torsion arm connected to both sides of the torsion spring body; the torsion spring body is mounted on the mounting base, the first torsion arm is abutted against the swing arm, the second torsion arm is abutted against the mounting base, the first torsion arm is pushed by the swing arm when the swing arm swings upward to generate the elastic potential energy for the torsion spring body.

In some embodiment, the swing arm includes a connecting arm and a pivoting arm, a first end of the connecting arm is cooperated with the positioning part, an upper end of the pivoting arm is connected to a second end of the connecting arm, a lower end of the pivoting arm is pivoted to the mounting base; the mounting base is provided with a torsion spring shaft which has the same axis with a pivoting position of the pivoting arm, the torsion spring body is sleeved on the torsion spring shaft, and the first torsion arm is abutted against the second end of the connecting arm.

In some embodiment, the cleaning assembly further includes a lifting drive assembly for driving the mounting base to move up and down, and the swing arm is configured to move up and down with the mounting base.

In some embodiment, the swing arm is provided with an abutting portion, the mounting base is provided with a blocking portion for blocking the abutting portion to limit downward swing of the swing arm; based on an engagement between the blocking portion and the abutting portion, the swing arm moves upward with an upward movement of the mounting base, and the swing arm moves downward with a downward movement of the mounting base since the blocking portion is kept in contact with the abutting portion due to the elastic potential energy of the elastic force applying member.

In some embodiment, a limit structure is provided between the mounting base and the swing arm and configured to limit downward swing of the swing arm.

In some embodiment, a limit structure is provided between the mounting base and the swing arm and configured to limit downward swing of the swing arm.

In some embodiment, the cleaning device includes a cleaning module for cleaning a surface and a rotating shaft for rotating the cleaning module, the cleaning module is installed on the rotating shaft, and the rotating shaft is connected with a rotation transmission mechanism that is connected with a rotation drive motor, and the rotating shaft is fixed in a circumferential direction and movable in an axial direction; the rotating shaft is fixedly connected to a sliding base and is rotatable relative to the sliding base, and the positioning part is formed on the sliding base.

Accordingly, the present disclosure further provides a cleaning robot including the aforementioned cleaning assembly.

In comparison with the prior art, the cleaning assembly of the present disclosure includes a cleaning device, a mounting base and a swing arm. The cleaning device is movable in a vertical direction, and a positioning part is provided on the cleaning device; the mounting base is located at one side of the cleaning device; and the swing arm has one end pivotally connected to the mounting base and another end connected to the positioning part, and the swing arm is configured to swing with a vertical movement of the positioning part. Such an arrangement is conducive to self-adaptive floating of the cleaning device, thereby improving the adaptability of a cleaning robot having the cleaning assembly.

BRIEF DESCRIPTION OF THE DRAWINGS

The accompanying drawings facilitate an understanding of the various embodiments of this disclosure.

DETAILED DESCRIPTION

In order to explain in detail the technical content, construction features, the purpose and effect achieved by the present disclosure, the following combined with the implementation and the attached drawings are described in detail.

Referring to FIGS. 1-13, the present disclosure provides a cleaning assembly including at least one cleaning device 10/10', at least one mounting base 20/20', and at least one swing arm 30/30'. Specifically, the cleaning device 10/10' is movable in a vertical direction with respect to mounting base 20/20', and a positioning part 11/11' is provided on the cleaning device 10/10'. The mounting base 20/20' is located on one side of the cleaning device 10/10'. The swing arm 30/30' has one end pivotally connected to the mounting base 20/20' and another end connected to the positioning part 11/11'. The swing arm 30/30' is configured to swing with a vertical movement of the positioning part 11/11'. Such a configuration is conducive to self-adaptive floating of the cleaning device 10/10', thereby improving the adaptability of a cleaning robot having the cleaning assembly.

As further shown in FIGS. 1-6, in some embodiments, the positioning part 11 is slidably connected to the swing arm 30, and the vertical movement of the positioning part 11 and the swing movement of the swing arm 30 are mutually converted under a relative sliding action between the positioning part 11 and the swing arm 30. When the cleaning device 10 is applied with an upward force from an obstacle, the positioning portion 11 may slide relative to the swing arm 30, and the swing arm 30 may swing accordingly. When the upward force disappears, the cleaning device 10 may return downward, and the swing arm 30 may swing back accordingly.

Figure 1:
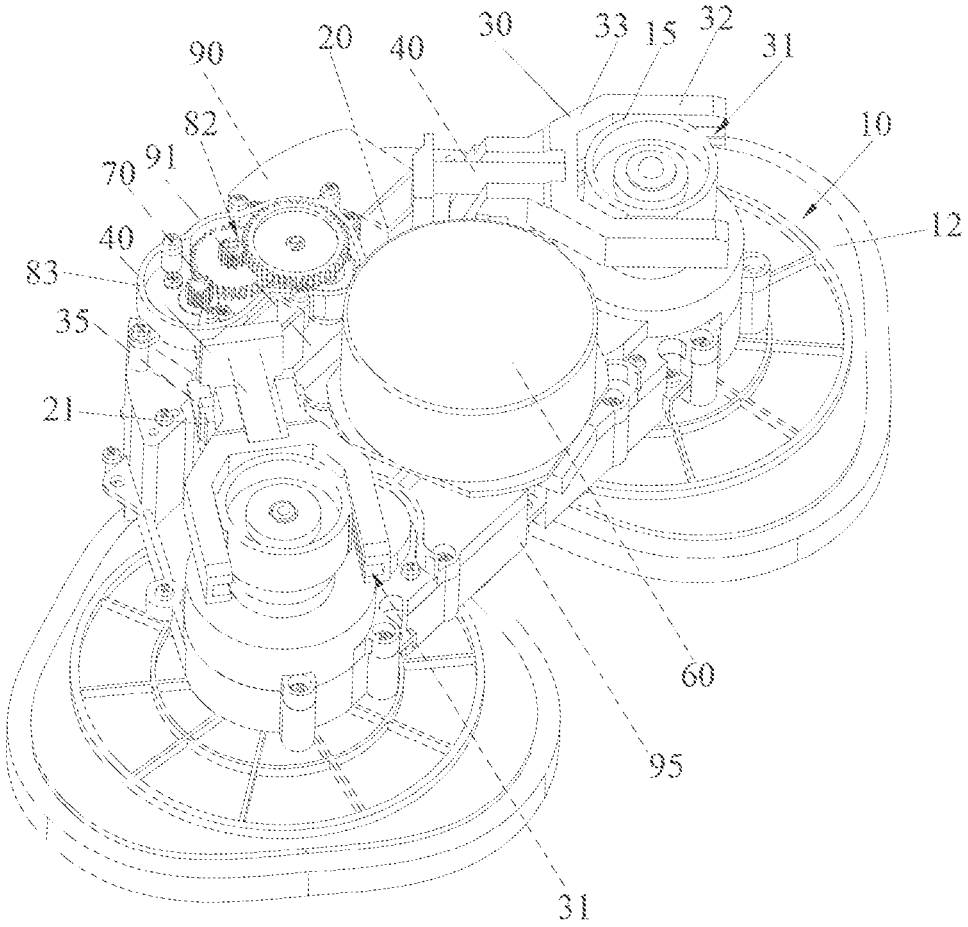
FIG. 1 is a perspective view of a cleaning assembly according to an embodiment of the present disclosure.
Figure 2:
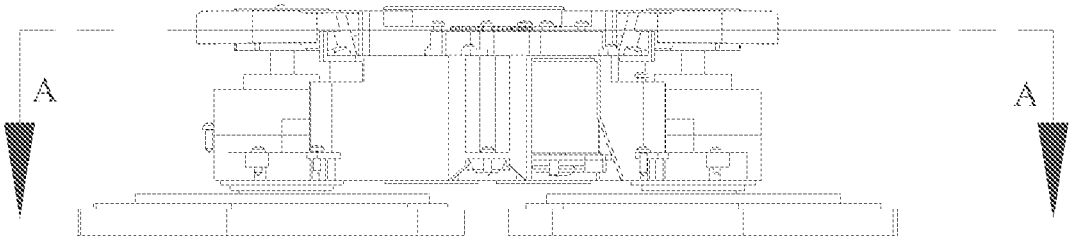
FIG. 2 is a side view of the cleaning assembly according to an embodiment of the present disclosure.
Figure 3:
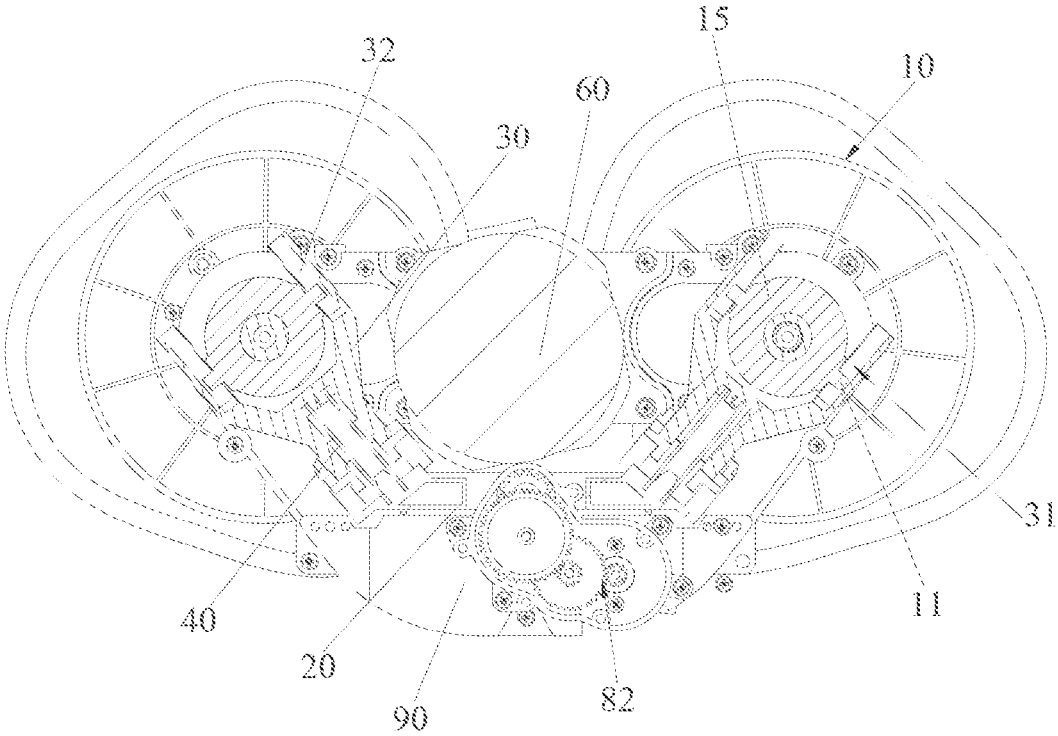
FIG. 3 is a cross-sectional view along a line A-A of the cleaning assembly shown in FIG. 2 according to an embodiment.
Figure 4:
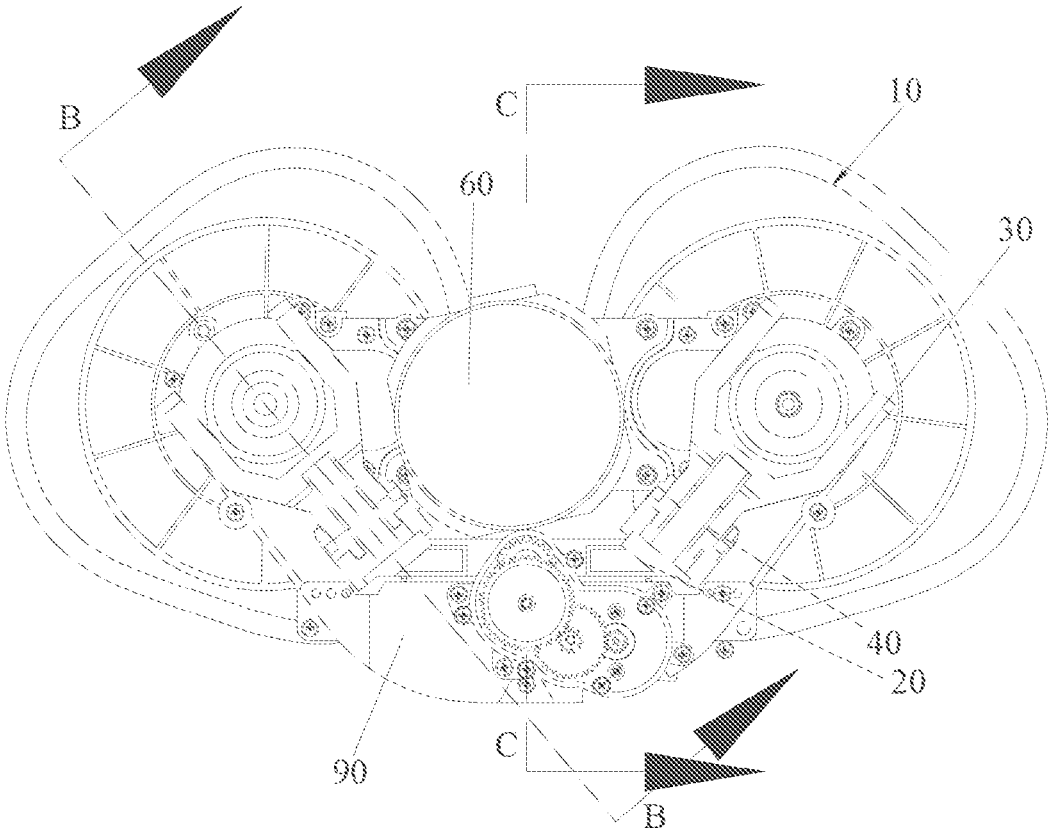
FIG. 4 is a top view of the cleaning assembly according to an embodiment of the present disclosure.

As shown in FIGS. 1 and 3, specifically, the swing arm 30 is provided with a sliding groove 31 in which the positioning part 11 is slidably configured, by means of a sliding action of the positioning part 11 in the sliding groove 31, the vertical movement of the positioning part 11 and the swing movement of the swing arm 30 may be mutually converted.

In order to achieve a more reliable engagement between swinging arm 30 and cleaning device 10, the swing arm 30 includes two arms 32 arranged opposite to each other, both arms 32 are respectively provided with a sliding groove 31, and the cleaning device 10 is provided with two said positioning parts 11 symmetrically arranged. Based on such a configuration, the two positioning parts 11 are correspondingly slidably arranged in the two sliding grooves 31.

In the present embodiment, the cleaning device 10 is configured to move upward to drive the swing arm 30 to swing through the positioning part 11 when applied with an upward force, and automatically return downward (by means of its own gravity, for example) once the upward force disappears. In such a way, the cleaning device 10 may achieve a self-adaptive floating.

In some embodiments, the cleaning assembly further includes an elastic force applying member. The elastic force applying member may store elastic potential energy when the cleaning device 10 is moved upward, and the cleaning device 10 may be returned downward under actions of a gravity of the cleaning device and a release of the elastic potential energy. Due to the existence of the elastic force applying member, the cleaning device 10 may achieve a stable self-adaptive floating.

Specifically, the elastic force applying member acts on the swing arm 30 in one embodiment, and the elastic force applying member is configured to store elastic potential energy when the cleaning device 10 is moved upward and release the elastic potential energy to facilitate a backswing of the swing arm 30 thereby facilitating the return of the cleaning device 10. In an alternative embodiment, the elastic applying member may directly act on the cleaning device 10.

Figure 5:
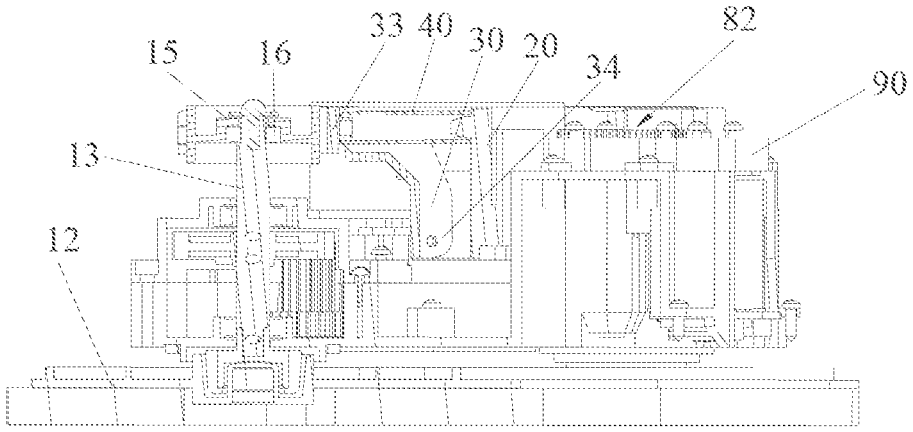
FIG. 5 is a cross-sectional view along the line B-B of the cleaning assembly shown in FIG. 4 according to an embodiment.

Referring to FIGS. 1, 3, and 5, in some embodiments, the elastic force applying member may include a compression spring 40 connected between the mounting base 20 and the swing arm 30, and the compression spring 40 is compressed to store elastic potential energy when the swing arm 30 swings upward (it mainly refers to that part connected with the swinging arm 30 and the cleaning device 10, which may swing upward when the cleaning device 10 is pushed upward). When the upward force disappears, the swinging arm 30 and the cleaning device 10 may reset due to the release of the elastic potential energy.

Specifically, the swing arm 30 includes a connecting arm 33 and a pivoting arm 34, a first end of the connecting arm 33 is cooperated with the positioning part 11, an upper end of the pivoting arm 34 is connected to a second end of the connecting arm 33, a lower end of the pivoting arm 34 is pivoted to the mounting base 20; and the compression spring 40 is connected between the second end of the connecting arm 33 and the mounting base 20. Of course, the swing arm 30 is not limited to the present particular form, and the compression spring 40 is not limited to the present arrangement.

In one embodiment, the cleaning assembly further includes a lifting drive assembly for driving the mounting base 20 to move up and down, and the swing arm 30 may move up and down with the movement of the mounting base 20, accordingly the cleaning device 10 may move and down as well. In such a way, the cleaning device 10 may be lifted up and kept in the lift position. Due to the lifting of the cleaning device 10, the cleaning robot may not be obstructed or affected by the cleaning device 10 when the cleaning robot moves but makes no cleaning action, thereby improving the adaptability of the cleaning robot.

Referring to FIG. 1, specifically, the swing arm 30 is provided with an abutting portion 35, and the mounting base 20 is provided with a blocking portion 21 for blocking the abutting portion 35 to limit the downward swing of the swing arm 30. Due to the engagement between the blocking portion 21 and the abutting portion 35, the swing arm 30 may move upward with an upward movement of the mounting base 20; and since the blocking portion 21 is kept in contact with the abutting portion 35 due to the elastic potential energy of the elastic force applying member, the swing arm 30 may move downward with a downward movement of the mounting base 20. In such a way, the swing arm 30 may be driven to stably move up and down, without any swings, as the mounting base 20 moves up and down.

In a specific example, the elastic potential energy of the horizontally arranged compression spring 40 may promote the blocking portion 21 and the abutting portion 35 to maintain firm contact, so that the swing arm 30 may move downward with the mounting base 20, meanwhile the swing of the swing arm 30 is prevented.

In one embodiment, the limiting structure provided to limit the downward swing of the swing arm 30 is not limited to the above manner in which the blocking portion 21 and the abutting portion 35 engage one another.

Referring to FIG. 1, in one embodiment, two cleaning devices 10 are configured. A swing arm 30 is connected between each cleaning device 10 and the mounting base 20, respectively, so that the two cleaning devices 10 share one said mounting base 20. When the cleaning devices 10 is lifted, only one set of lifting drive assembly is required to drive the mounting base 20, which may effectively reduce space occupation.

Figure 6:
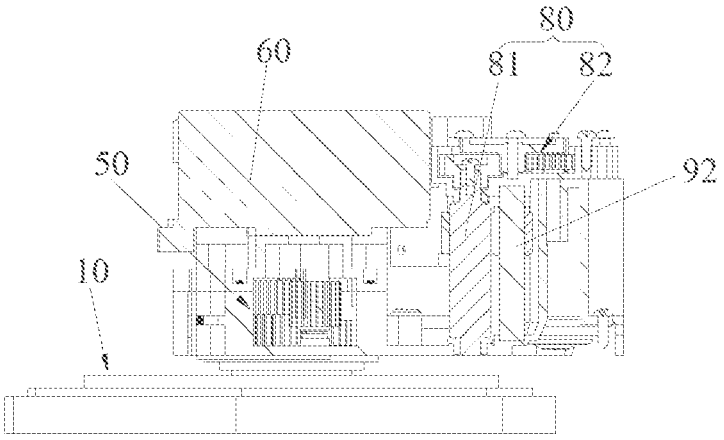
FIG. 6 is a cross-sectional view along the line C-C of the cleaning assembly shown in FIG. 4 according to an embodiment.

Referring to FIGS. 1, 5 and 6, in one embodiment, the cleaning device 10 may include a cleaning module 12 for cleaning a surface and a rotating shaft 13 for rotating the cleaning module 12. Specifically, the cleaning module 12 is installed on the rotating shaft 13, and the rotating shaft 13 is connected with a rotation transmission mechanism 50 that is connected with a rotation drive motor 60. More specifically, the rotating shaft 13 is fixed in a circumferential direction and movable in an axial direction. As shown, the rotating shaft 13 is fixedly connected to a sliding base 15 and is rotatable relative to the sliding base 15, and the positioning part 11 is formed on the sliding base 15. In such a way, the cleaning device 10 not only may realize the rotary cleaning to the surface, but also may realize lifting and self-adaptive floating by the axial movement of the rotating shaft 13. In a specific example, the cleaning module 12 is a mopping module, which is not limited here however. The sliding base 15 may be served as an end cover, and a bearing 16 is arranged between the sliding base 15 and the rotating shaft 13.

The rotating shaft that is movable in the axial direction may be realized through a key joint between the rotating shaft and the rotation transmission mechanism. Other types of connection between the rotating shaft and the rotation transmission mechanism may also be appreciated by one of ordinary skill in the art. For example, the rotating shaft is integrally formed with a gear part, which may allow an axial movement of the rotating shaft relative to the transmission mechanism.

It should be noted that the lifting and self-adaptive floating of the cleaning device here are not necessarily realized by the axial movement of the rotating shaft. For example, it may also be realized by the overall lifting and floating of the rotation drive motor, the rotation transmission mechanism and the cleaning device. The cleaning device is not limited to this form and may not have a rotating function, for example. In addition, it should be noted that, the fixed connection between the rotating shaft and the sliding base may allow no relative movement between each other. Such fixed connection, however, may not affect the rotation of the rotating shaft. The fixed connection may be other types of connection, such as a locking member.

Referring to FIG. 1, in the one embodiment, the cleaning assembly further includes a fixing base 90 on which the lifting drive assembly is installed. As shown, the fixing base 90 is formed with a recess 91, and the mounting base 20 is arranged correspondingly to the recess 91. In such a way, the space occupation may be further reduced in the direction of height.

Referring to FIGS. 1 and 6, specifically, the lifting drive assembly includes a lifting drive motor 70 and a lifting transmission mechanism 80, the lifting transmission mechanism 80 includes a screw rod 81 and a gear set 82 respectively connected to the lifting drive motor 70 and the screw rod 81, and the screw rod 81 is connected with the mounting base 20 through a threaded connection so as to lift the mounting base 20. The lifting drive motor 70 is installed in the fixing base 90, and the lifting drive motor 70 has an output shaft extended upward from the fixing base 90 to connect with the gear set 82, the gear set 82 is mounted on the fixing base 90 through a gear box 83, and the gear box 83 is partially suspended directly above the recess 91 so that the gear set 82 is connected with the screw rod 81. Such an arrangement may provide a compact structure and save space. The lifting drive assembly is not limited to the above manner however.

Specifically, the fixing base 90 is provided with a guide rod 92, and the mounting base 20 is vertically slidably arranged on the guide rod 92. Under the guide of the guide rod 92, the lifting operation of the mounting base 20 is reliable.

In some embodiments, as shown in FIGS. 1, 5, and 6, the rotating shafts 13 of the two cleaning devices 40 are located at the same side of the mounting base 20, the two swing arms 30 are biased relative to the mounting base 20 to respectively connect with the corresponding rotating shaft 13. Further, the fixing base 90 is formed with a gear box 95, the gear box 95 and the rotating shafts 13 are located at the same side of the mounting base 20 and located directly above the two cleaning modules 12. Further, a rotation drive motor 60 is formed on the gear box 95, and the gear box 95 is provided with a gear set as the rotation transmission mechanism 50 for driving the rotation drive motor 60 and the rotating shafts 13. As a result, a saving of space is achieved.

Figure 7:
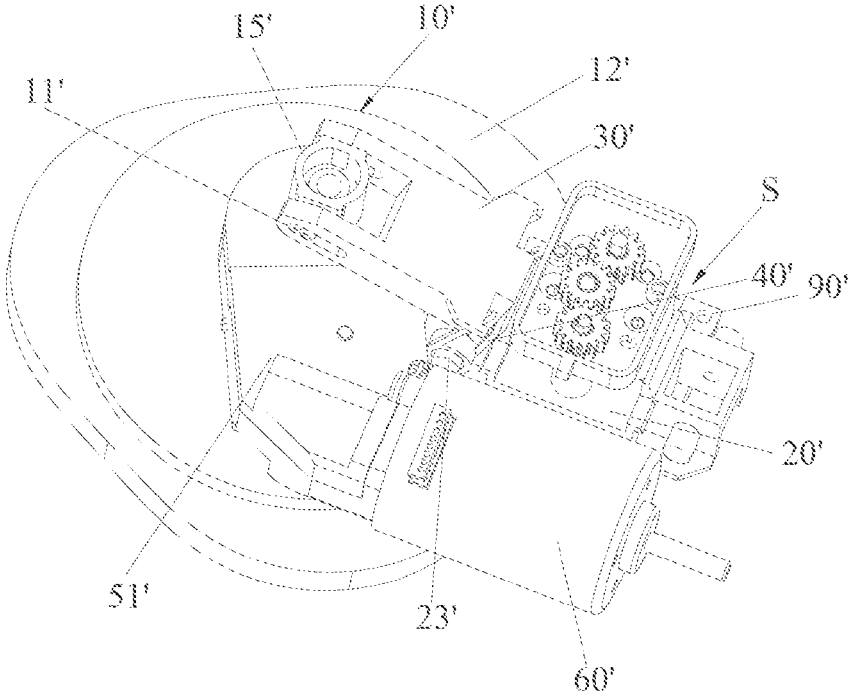
FIG. 7 is a perspective view of the cleaning assembly according to an embodiment of the present disclosure.
Figure 8:
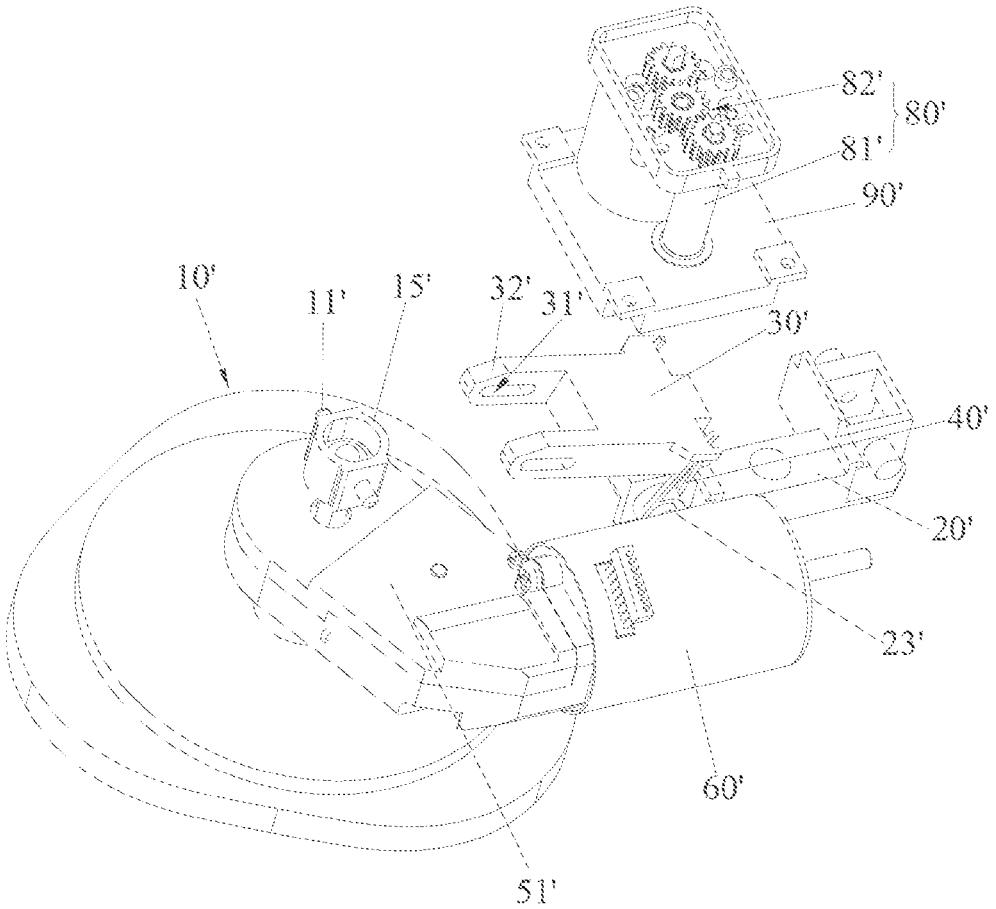
FIG. 8 is an exploded view of the cleaning assembly according an embodiment of to the present disclosure.
Figure 9:
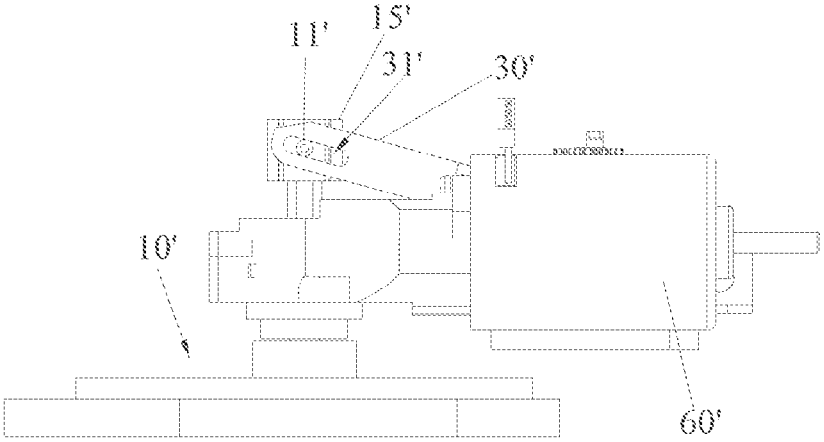
FIG. 9 is a side view of the cleaning assembly according to an embodiment of the present disclosure.
Figure 10:
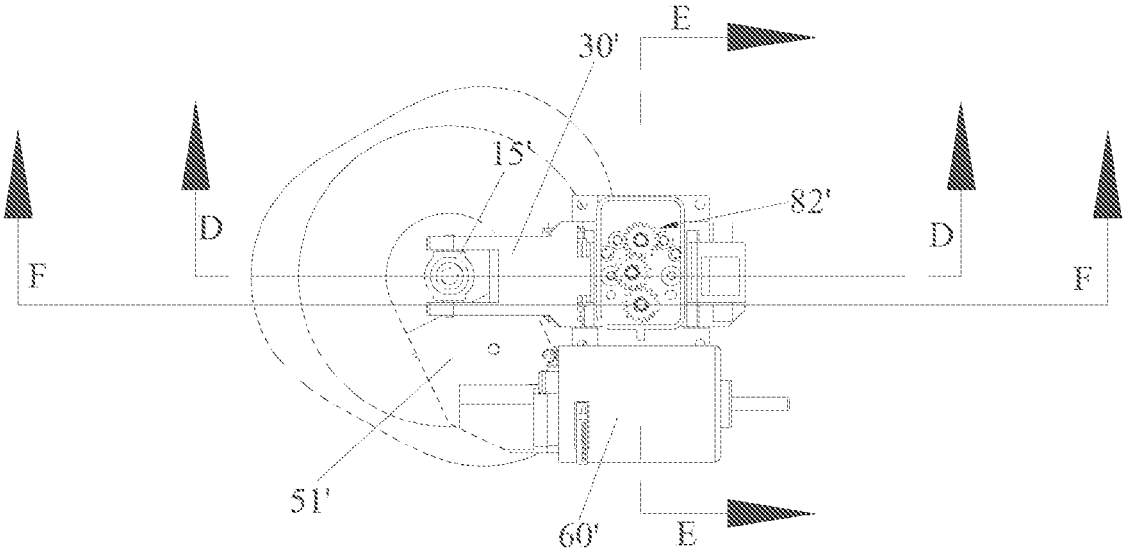
FIG. 10 is a top view of the cleaning assembly according to an embodiment of the present disclosure.

FIGS. 7-13 show a cleaning assembly according to some other embodiments of the disclosure. Referring to FIGS. 7 and 8, in one embodiment, the positioning portion 11' and the swing arm 30' are connected in substantially the same manner as that shown in FIGS. 1-6. The swing arm 30' is also provided with a sliding groove 31' that is engaged with the positioning portion 11'. In order to achieve a more reliable engagement between the swing arm 30' and the cleaning device 10', the swing arm 30' also includes two arms 32' arranged oppositely, and the both arms 32' are provided with a sliding groove 31' respectively. The cleaning device 10' is provided with two positioning parts 11' symmetrically arranged. Based on such a configuration, the two positioning parts 11' are correspondingly slidably arranged in the respective sliding grooves 31'.

Figure 13:
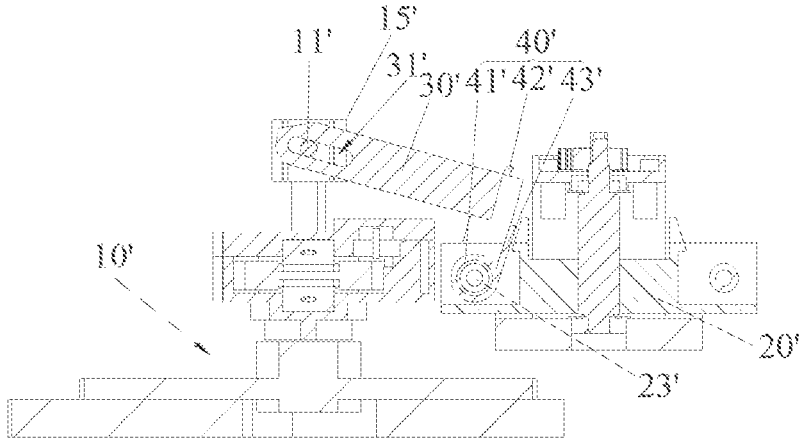
FIG. 13 is a cross-sectional view along the line F-F of the cleaning assembly shown in FIG. 10 according to an embodiment.

Referring to FIGS. 7 and 13, in one embodiment, the elastic force applying member is in the form of a torsion spring. Specifically, the torsion spring 40' has a torsion spring body 41', a first torsion arm 42', and a second torsion arm 43' connected to both sides of the torsion spring body 41'. The torsion spring body 41' is mounted on the mounting base 20'. The first torsion arm 42' is abutted against the swing arm 30'. The second torsion arm 43' is abutted against the mounting base 20'. In such an arrangement, the first torsion arm 42' may be pushed by the swing arm 30' when the swing arm 30' swings upward to generate the elastic potential energy for the torsion spring body 41'. The swing arm 30' may make a backswing under a release of the elastic potential energy.

Figure 11:
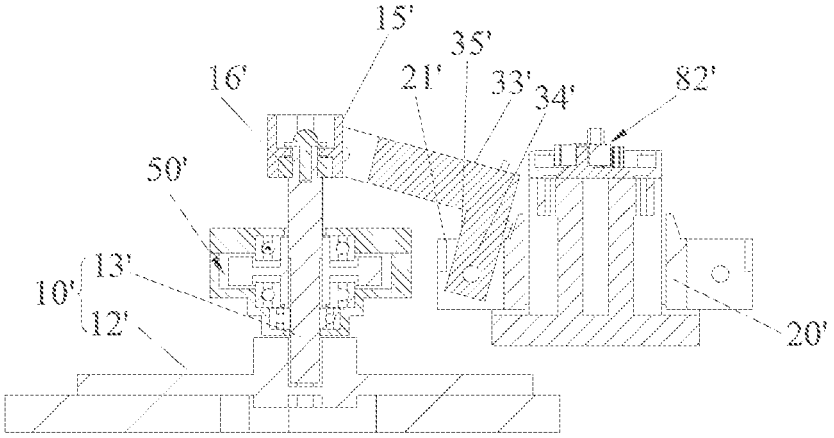
FIG. 11 is a cross-sectional view along the line D-D of the cleaning assembly shown in FIG. 10 according to an embodiment.

Referring to FIGS. 11 and 13, specifically, the swing arm 30' includes a connecting arm 33' and a pivoting arm 34'. A first end of the connecting arm 33' is cooperated with the positioning part 11'. An upper end of the pivoting arm 34' is connected to a second end of the connecting arm 33'. A lower end of the pivoting arm 34' is pivotally connected to the mounting base 20'. The mounting base 20' is provided with a torsion spring shaft 23' which has the same axis with a pivoting joint of the pivoting arm 34'. The torsion spring body 41' is sleeved on the torsion spring shaft 23', and the first torsion arm 42' is abutted against the second end of the connecting arm 33'.

Referring to FIG. 11, in one embodiment, the swing arm 30' is provided with an abutting portion 35', and the mounting base 20' is provided with a blocking portion 21' for blocking the abutting portion 35' to limit the downward swing of the swing arm 30'. Due to the engagement between the blocking portion 21' and the abutting portion 35', the swing arm 30' may move upward with an upward movement of the mounting base 20'. The limiting structure provided to limit the downward swing of the swing arm 30' is not limited to the these embodiments in which the blocking portion 21' and the abutting portion 35' engage one another.

In one embodiment, the cleaning assembly also includes a lifting drive assembly for driving the mounting base 20' to move up and down. Specifically, when the mounting base 20' is driven to move downward, the blocking portion 21' is kept in contact with the abutting portion 35' due to the elastic potential energy of the torsion spring 40', so that the swing arm 30' moves downward with the mounting base 20'.

Please refer to FIG. 7, two cleaning devices 10' may be configured in some embodiments. A swing arm 30' is connected between each cleaning device 10' and the mounting base 20', respectively, so that the two cleaning devices 10' share one mounting base 20'. When the cleaning devices 10' are lifted, only one set of lifting drive assembly is required to drive the mounting base 20', which may effectively reduce the space occupation.

Referring to FIGS. 7 and 11, in some embodiment, the cleaning device 10' may include a cleaning module 12' for cleaning a surface and a rotating shaft 13' for rotating the cleaning module 12'. Specifically, the rotating shaft 13' is connected with a rotation transmission mechanism 50' that is connected with a rotation drive motor 60'. More specifically, the rotating shaft 13' is fixed in a circumferential direction and movable in an axial direction. As shown, the rotating shaft 13' is fixedly connected to a sliding base 15' and is rotatable relative to the sliding base 15'. The positioning part 11' is formed on the sliding base 15'. In such a way, the cleaning devices 10' not only may realize the rotary cleaning to the surface, but also may realize lifting and self-adaptive floating by the axial movement of the rotating shaft 13'. In a specific example, the cleaning module 12' is a mopping module or other cleaning modules. The sliding base 15' may be served as an end cover. A bearing 16' is arranged between the sliding base 15' and the rotating shaft 13'.

Figure 12:
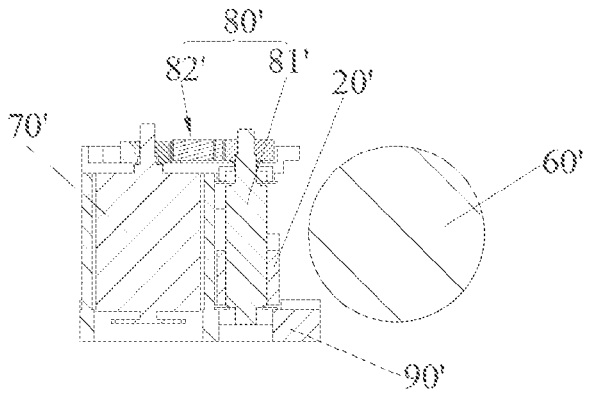
FIG. 12 is a cross-sectional view along the line E-E of the cleaning assembly shown in FIG. 10 according to an embodiment.

As shown in FIGS. 1, 11 and 12, the rotating shafts 13' of the two cleaning devices 10' are located at the same side of the rotation drive motor 60'. Two rotation transmission mechanisms 50' are connected to the respective rotating shaft 13' and respectively installed in two rotation transmission boxes 51'. An accommodating space for receiving the lifting assembly and the mounting base 20' is formed between the two rotation transmission boxes 51'. Specifically, the lifting drive assembly mounted on a fixing base 90' includes a lifting drive motor 70' and a lifting transmission mechanism 80'. The lifting transmission mechanism 80' includes a screw rod 81' and a gear set 82'. The screw rod 81' is connected with the mounting base 20' through a threaded connection so as to lift the mounting base 20'. Such arrangement provides a compact structure that may save space.

While the disclosure has been described in connection with what are presently considered to be the most practical and preferred embodiments, it is to be understood that the disclosure is not to be limited to the disclosed embodiments, but on the contrary, is intended to cover various modifications and equivalent arrangements included within the spirit and scope of the disclosure.

What is claimed is:

1. A cleaning assembly, comprising:

a mounting base including a blocking portion;

a cleaning device, configured to move in a vertical direction with respect to the mounting base, the cleaning device including at least one positioning part;

a swing arm, having a first end pivotally connected to the mounting base and a second end connected to the positioning part, the swing arm being configured to swing in response to a vertical movement of the positioning part, the swing arm further including an abutting portion, wherein the blocking portion of the mounting base is configured to block the abutting portion to limit a downward swing of the swing arm; and an elastic member acting on the swing arm and configured to store elastic potential energy when the cleaning device moves upward, wherein through an engagement between the blocking portion and the abutting portion, the mounting base, when moving upward, drives the swing arm upward, and wherein through the contact between the blocking portion and the abutting portion maintained by the elastic potential energy of the elastic member, the mounting base, when moving downward, drives the swing arm downward.

2. The cleaning assembly according to claim 1, wherein the positioning part is slidably connected to the swing arm, and the vertical movement of the positioning part and a swing movement of the swing arm are mutually converted to each other through a relative sliding action between the positioning part and the swing arm.

3. The cleaning assembly according to claim 1, wherein the swing arm includes a sliding groove, the positioning part is slidably coupled to the sliding groove, and the vertical movement of the positioning part and a swing movement of the swing arm are mutually converted to each other through a sliding action of the positioning part in the sliding groove.

4. The cleaning assembly according to claim 1, wherein the swing arm comprises two arms opposite to each other, each of the arms includes a sliding groove, the at least one positioning part includes two positioning parts symmetrically arranged on the cleaning device and opposite to each other, and the two positioning parts are respectively, slidably coupled with the two sliding grooves.

5. The cleaning assembly according to claim 1, wherein the cleaning device is configured to move upward when an upward force is applied and drive, through the positioning part, the swing arm to swing, and automatically return downward when the upward force is withdrawn.

6. The cleaning assembly according to claim 5, the cleaning device being configured to return downward under at least one of a gravity or a release of the elastic potential energy by the elastic member.

7. The cleaning assembly according to claim 6, wherein the elastic member acting on the swing arm is configured to release the elastic potential energy to facilitate a backswing of the swing arm when the cleaning device moves downward.

8. The cleaning assembly according to claim 7, wherein the elastic member comprises a compression spring connected between the mounting base and the swing arm, and the compression spring is compressed to store the elastic potential energy when the cleaning device moves upward.

9. The cleaning assembly according to claim 8, wherein the swing arm comprises a connecting arm and a pivoting arm, a first end of the connecting arm is connected to the positioning part, an upper end of the pivoting arm is connected to a second end of the connecting arm, a lower end of the pivoting arm is pivotally connected to the mounting base, and the compression spring is connected between the second end of the connecting arm and the mounting base.

10. The cleaning assembly according to claim 7, wherein the elastic member comprises a torsion spring having a torsion spring body, a first torsion arm and a second torsion arm connected to two sides of the torsion spring body, the torsion spring body is mounted on the mounting base, the first torsion arm is abutted against the swing arm, the second torsion arm is abutted against the mounting base, the first torsion arm is pushed by the swing arm when the swing arm swings upward to store the elastic potential energy in the torsion spring body.

11. The cleaning assembly according to claim 10, wherein the swing arm comprises a connecting arm and a pivoting arm, a first end of the connecting arm is connected to the positioning part, an upper end of the pivoting arm is connected to a second end of the connecting arm, a lower end of the pivoting arm is pivotally connected to the mounting base, the mounting base includes a torsion spring shaft coaxially aligned with a pivotal joint of the pivoting arm, the torsion spring body is sleeved on the torsion spring shaft, and the first torsion arm is abutted against the second end of the connecting arm.

12. The cleaning assembly according to claim 7, further comprising a lifting drive assembly for driving the mounting base to move vertically, the swing arm being configured to move vertically with the mounting base.

13. The cleaning assembly according to claim 1, wherein the cleaning device comprises a cleaning module for cleaning a surface and a rotating shaft for rotating the cleaning module, the cleaning module is installed on the rotating shaft, and the rotating shaft is connected with a rotation transmission mechanism that is connected with a motor, and the rotating shaft is movable in an axial direction with respect to the motor;

the rotating shaft is fixedly connected to a sliding base and is rotatable relative to the sliding base, and the positioning part is formed on the sliding base.

14. A cleaning robot, comprising:

a housing; and a cleaning assembly, comprising:

a mounting base including a blocking portion;

a cleaning device, configured to move in a vertical direction with respect to the mounting base, the cleaning device including at least one positioning part;

a swing arm, having a first end pivotally connected to the mounting base and a second end connected to the positioning part, the swing arm being configured to swing in response to a vertical movement of the positioning part, the swing arm further including an abutting portion, wherein the blocking portion of the mounting base is configured to block the abutting portion to limit a downward swing of the swing arm; and an elastic member acting on the swing arm and configured to store elastic potential energy when the cleaning device moves upward, wherein through an engagement between the blocking portion and the abutting portion, the mounting base, when moving upward, drives the swing arm upward, and wherein through the contact between the blocking portion and the abutting portion maintained by the elastic potential energy of the elastic member, the mounting base, when moving downward, drives the swing arm downward.

15. The cleaning robot according to claim 14, wherein the positioning part is slidably connected to the swing arm, and the vertical movement of the positioning part and a swing movement of the swing arm are mutually converted to each other through a relative sliding action between the positioning part and the swing arm.

16. The cleaning robot according to claim 14, wherein the swing arm includes a sliding groove, the positioning part is slidably coupled to the sliding groove, and the vertical movement of the positioning part and a swing movement of the swing arm are mutually converted to each other through a sliding action of the positioning part in the sliding groove.

17. The cleaning robot according to claim 14, wherein the swing arm comprises two arms opposite to each other, each of the arms includes a sliding groove, the at least one positioning part includes two positioning parts symmetrically arranged on the cleaning device and opposite to each other, and the two positioning parts are respectively, slidably coupled with the two sliding grooves.

* * * * *